United States Patent [19]

Bridges et al.

[11] Patent Number: 4,911,480

[45] Date of Patent: Mar. 27, 1990

[54] TORQUE NUT FOR SETTING A GRAPHITE SEAL

[75] Inventors: Charles D. Bridges; Anton J. Dach, Jr., both of Houston, Tex.

[73] Assignee: Vetco Gray Inc., Houston, Tex.

[21] Appl. No.: 327,764

[22] Filed: Mar. 23, 1989

[51] Int. Cl.[4] ..... F16L 35/00

[52] U.S. Cl. ..... 285/39; 285/144; 285/348; 285/356; 285/910

[58] Field of Search ..... 285/139, 140, 141, 142, 285/143, 144, 145, 146, 147, 39, 348, 356, 910

[56] References Cited

U.S. PATENT DOCUMENTS

| | | | |
|---|---|---|---|
| 318,447 | 5/1885 | Campbell . | |
| 1,427,318 | 8/1922 | Payne | 285/39 X |
| 1,734,040 | 11/1929 | McEvoy . | |
| 1,807,046 | 5/1931 | Rasmussen et al. | 285/144 |
| 1,892,377 | 12/1932 | Bergskaug . | |
| 2,104,808 | 1/1938 | Neuhaus et al. | 285/142 |
| 2,902,302 | 9/1959 | Ackermann . | |
| 3,185,505 | 5/1965 | Lanmon | 285/141 X |
| 3,248,132 | 4/1966 | Pierce | 285/141 X |
| 4,343,495 | 8/1982 | Nobileau et al. | 285/39 X |
| 4,360,186 | 11/1982 | Tinsley et al. . | |
| 4,577,873 | 3/1986 | Baumann . | |

OTHER PUBLICATIONS

PI-8831 Stock No. CL01748 Drawing.

*Primary Examiner*—Dave W. Arola
*Attorney, Agent, or Firm*—James E. Bradley

[57] ABSTRACT

A well has an improved means for sealing an annular space within the bore of the wellhead housing surrounding the casing. An annular shoulder is stationarily located in the bore of the wellhead housing. A seal locates on top of the annular shoulder, the seal having a graphite material central section sandwiched between upper and lower metal rings. A cylindrical torque nut, having external threads which engage threads located in the bore of the wellhead housing, has a lower rim which engages the upper metal ring of the seal. The torque nut has a bore therethrough with at least one vertical groove formed therein for receiving a torque tool to rotate the torque nut for expanding the central section of the seal against the casing and wellhead housing to a selected amount.

3 Claims, 1 Drawing Sheet

TORQUE NUT FOR SETTING A GRAPHITE SEAL

BACKGROUND OF THE INVENTION

1. Field of the Invention

This invention relates in general to oil and gas well equipment, and in particular to a device for setting a graphite seal between casing and a wellhead housing.

2. Description of the Prior Art

In an oil and gas well, a wellhead housing of some type will be located at the surface. Casing will extend through the wellhead housing and be cemented in place. In one type of installation, a casing hanger is secured to the upper end of the casing. The casing hanger has a smooth external surface. A seal or packoff seals the annular space between the casing hanger external surface and the wellhead.

In another type of installation, the seal locates between the wellhead housing and the casing itself. This installation may be used when the casing sticks in the well, and has to be cut off in a place such that a casing hanger cannot be used.

One type of seal for sealing against casing has a graphite central section sandwiched between upper and lower metal rings. The seal will be located on top of a shoulder in the bore of the wellhead housing. An upper wellhead housing, such as a tubing head, bolts to the lower wellhead housing. The upper wellhead housing has a downward facing shoulder that engages the seal. As the upper wellhead housing is secured in place, it will compress the seal, causing it to expand and seal against the casing.

While this is satisfactory, it does not allow the compression on the seal to be precisely set. The compression force exerted on the seal results from the difference in axial dimension between the seal initially and the shoulders in the upper and lower wellhead housings.

SUMMARY OF THE INVENTION

In this invention, a graphite seal locates on an annular shoulder in the bore of the wellhead housing. A cylindrical torque nut mounts in the bore of the wellhead housing, also. The torque nut has external threads that engage threads in the bore. The torque nut has internal splines. A running tool, such as a wrench, can be lowered through the bore into engagement with the splines. Rotating the wrench rotates the torque nut downward The lower rim of the torque nut engages the seal, and compresses it to the desired amount of pressure.

DESCRIPTION OF THE PREFERRED EMBODIMENT

Figure 1:
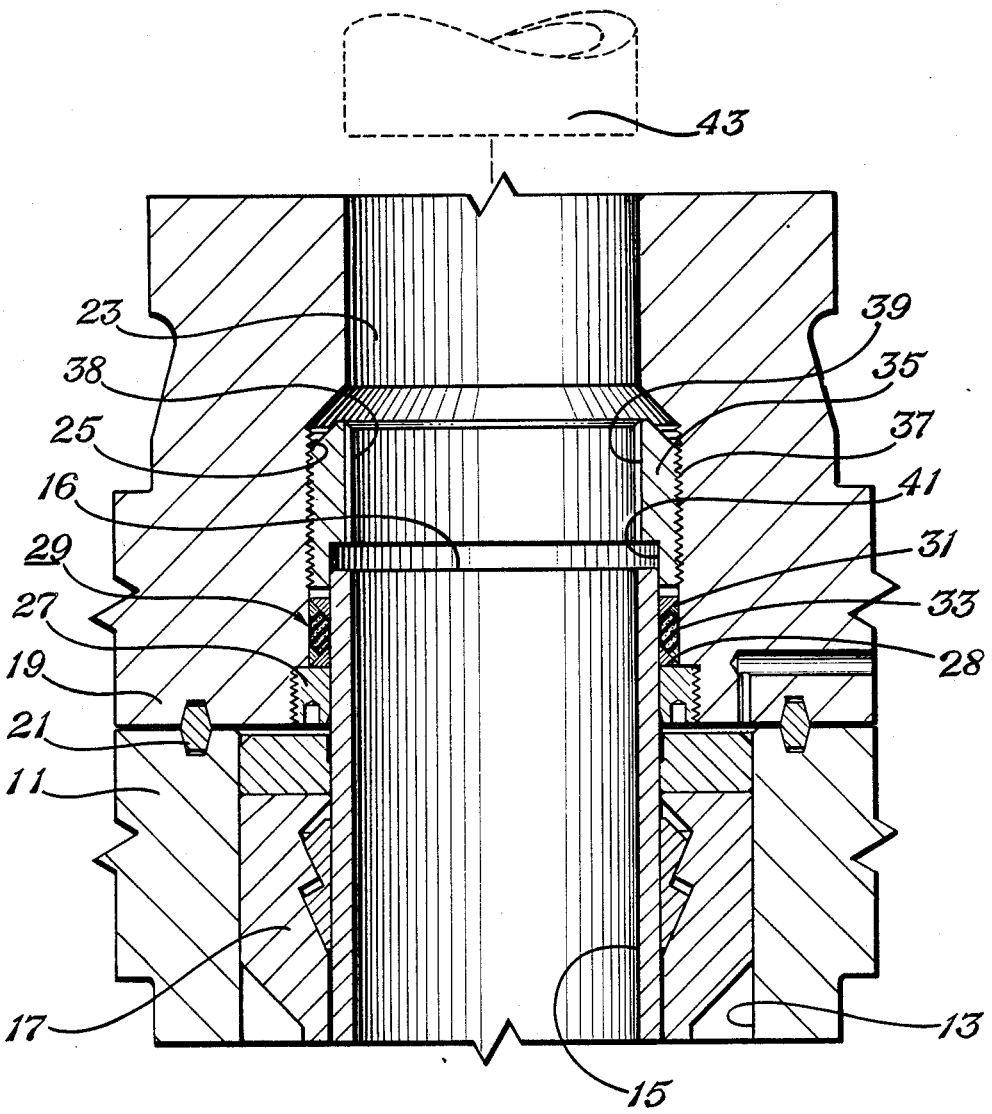
FIG. 1 is the sole FIGURE and it is a vertical sectional view illustrating a torque nut for setting a graphite seal, constructed in accordance with this invention.

Referring to FIG. 1, the wellhead housing includes a lower wellhead housing 11, which could be a casing head or spool, or a starting spool. The lower wellhead housing 11 has a bore 13 that extends through it. A string of casing 15 extends through the lower wellhead housing 11 and protrudes upward from it. The casing 15 will be cemented in place. The casing 15 will also be supported by a set of conventional slips 17. Normally, a seal, such as an elastomeric seal (not shown) will seal between the casing 15 and the bore 13 of the lower wellhead housing 11.

The wellhead housing also includes an upper wellhead housing 19, which lands on top of the lower wellhead housing 11. The upper wellhead housing 19 may be a tubing head or bonnet or some other type of structure. The upper wellhead housing 19 has flanges (not shown) which bolt to the lower wellhead housing 11. A metal seal ring 21 seals the junction of the lower wellhead housing 11 with the upper wellhead housing 19.

A bore 23 extends through the upper wellhead housing 19 coaxial with the bore 13. Bore 23 has on its lower end a counterbore 25 of larger diameter. A retaining ring 27 is secured by threads into the lower end of the counterbore 25. The retaining ring 27 has an upward facing shoulder 28 on its upper side.

A seal ring 29 lands on top of the shoulder 28 of the retaining ring 27. Seal ring 29 is a conventional type. It has anti-extrusion metal rings 31 on the upper and lower ends. A central section 33 sandwiches between the rings 31 and contains a graphite material. The anti-extrusion rings 31 have tapered mating surfaces to prevent extrusion of the central section 33 when compressed axially. When in position, the seal ring 29 will be located a short distance below the upper rim 16 of the casing 15.

A torque nut 35 mounts to the upper wellhead housing 19 in the counterbore 25. The torque nut 35 is a tubular, cylindrical member, having external threads 37 which engage mating threads formed in the counterbore 25. The torque nut 35 has a bore 38 extending through it which is coaxial with the bores 13 and 23. A plurality of splines 39 comprising vertically formed grooves are located in the bore 38 of torque nut 35. Bore 38 has a counterbore 41 on its lower end which has a diameter that is slightly greater than the outer diameter of the casing 15. This results in a lip or rim that extends downward around the casing 15 to engage the seal ring 29. The diameter of bore 38 above the counterbore 41 is substantially the same as the inner diameter of the casing 15. A wrench 43 may be lowered through the bore 23 to engage the splines 39. Wrench 43 has mating splines or keys to engage the torque nut 35. Rotation of the wrench 43 in one direction causes the torque nut 35 to move downward, compressing the seal ring 29.

In operation, the casing 15 will be lowered into the well and cemented in place. The hanger 17 will support the casing 15 on the lower wellhead housing 11. The torque nut 35 is screwed into the counterbore 25. The seal ring 29 is placed in the counterbore 25. Then the retaining ring 27 is screwed into the counterbore 25. Then the upper wellhead housing 19 is lowered onto the lower wellhead housing 11. The upper wellhead housing 19 will then be bolted to the lower wellhead housing 11.

Wrench 43 is lowered through the bore 23 into engagement with the torque nut 35. The operator rotates the wrench 43, causing the torque nut 35 to advance downward. The torque nut 35 will apply an axial force to the seal ring 29, causing it to radially expand. The seal ring 29 will form a tight seal between the casing 15 and the counterbore 25. Then the wrench 43 will be retrieved. When fully made up, the shoulder at the upper end of the torque nut counterbore 41 will be spaced a slight distance above the rim 16 of the casing 15.

The invention has significant advantages. The torque nut allows a selected axial force to be applied to the graphite seal ring. This assures the proper amount of compression for high pressure sealing.

While the invention has been shown in only one of its forms, it should be apparent to those skilled in the art that it is not so limited, but is susceptible to various changes without departing from the scope of the invention.

We claim:

1. In a well having a string of casing extending into a bore of a wellhead housing which has an upper section that secures to a lower section, an improved means for sealing an annular space within the bore of the wellhead housing surrounding the casing, comprising in combination:

annular shoulder stationarily located in the bore of the wellhead housing;

a seal on top of the annular shoulder, the seal having a graphite material central section sandwiched between upper and lower metal rings;

a set of threads located in the bore of the wellhead housing within the upper section of the wellhead housing;

a cylindrical torque nut, having external threads which engage the threads located in the bore of the wellhead housing, the torque nut having a lower rim which engages the upper metal ring of the seal, the torque nut having an upper end located below the upper termination of the upper section of the wellhead housing; and the torque nut having a bore therethrough with at least one vertical groove formed therein for receiving a torque tool to rotate the torque nut for expanding the central section of the seal against the casing and wellhead housing to a selected amount.

2. In a well having a string of casing extending into a bore of a wellhead housing which has an upper section that secures to a lower section, an improved means for sealing an annular space within the bore of the wellhead housing surrounding the casing, comprising in combination:

an annular shoulder stationarily located in the bore;

an enlarged diameter counterbore section extending above the annular shoulder in a lower end of the bore within the upper section of the wellhead housing;

a seal on top of the annular shoulder, the seal having a graphite material central section sandwiched between upper and lower metal rings;

a cylindrical torque nut, having external threads which engage threads located in the counterbore, the torque nut having a lower rim which extends around the casing and engages the upper metal ring of the seal; and the torque nut having a bore therethrough with at least one vertical groove formed therein for receiving a torque tool to rotate the torque nut for compressing the central section of the seal against the casing to a selected amount, the torque nut having an inner diameter at the location of the groove which is substantially the same as the inner diameter of the casing.

3. In a well having a string of casing extending through a bore of a lower wellhead housing and protruding upward therefrom into a bore of an upper wellhead housing, the upper wellhead housing being secured to the lower wellhead housing, an improved means for sealing an annular space within the bore of the upper wellhead housing surrounding the casing, comprising in combination:

an enlarged diameter counterbore section located in a lower end of the bore of the upper wellhead housing, the casing having an upper rim located a selected distance below an upper end of the counterbore section;

an annular shoulder stationarily located in the counterbore section at a lower end of the counterbore section below the upper rim of the casing;

a seal positioned on top of the annular shoulder and below the upper rim of the casing, the seal having a graphite material central section sandwiched between upper and lower metal rings;

a cylindrical torque nut, having external threads which engage threads formed in the counterbore section of the bore of the upper wellhead housing, the torque nut having a lower rim which engages the upper metal ring of the seal;

the torque nut having a bore therethrough with a lower section and an upper section, the lower section being of larger diameter than the upper section, defining a downward facing shoulder which is positioned above the upper rim of the casing, the upper section of the bore of the torque nut being of substantially the same diameter as the casing; and at least one vertical groove formed in the bore of the torque nut for receiving a torque tool to rotate the torque nut for compressing the central section of the seal against the casing and upper wellhead housing to a selected amount.

* * * * *